US009155385B2

(12) United States Patent
Williams

(10) Patent No.: US 9,155,385 B2
(45) Date of Patent: Oct. 13, 2015

(54) DISPLAY DEVICE

(76) Inventor: Victor David Williams, Salt Lake City, UT (US)

( * ) Notice: Subject to any disclaimer, the term of this patent is extended or adjusted under 35 U.S.C. 154(b) by 261 days.

(21) Appl. No.: 13/470,686

(22) Filed: May 14, 2012

(65) Prior Publication Data

US 2012/0285954 A1 Nov. 15, 2012

Related U.S. Application Data

(60) Provisional application No. 61/485,875, filed on May 13, 2011.

(51) Int. Cl.

| | |
|---|---|
| ***A47F 7/00*** | (2006.01) |
| ***A47B 57/04*** | (2006.01) |
| ***A47F 5/00*** | (2006.01) |

(52) U.S. Cl.

CPC ..... *A47B 57/04* (2013.01); *A47F 5/0037* (2013.01)

(58) Field of Classification Search

CPC ..... B25H 3/04; B65D 21/0204; B65D 1/30; B65D 21/0202; B65D 81/361; A47J 47/18

USPC ..... 220/23.2, 23.4; 211/133.6, 194, 59.2, 211/70.6, 74, 86.01, 88.01, 94.01, 69; 362/121, 161; D26/13, 9; D8/71; 206/378, 303, 377, 379, 350

See application file for complete search history.

(56) References Cited

U.S. PATENT DOCUMENTS

| | | | | | |
|---|---|---|---|---|---|
| 3,311,402 | A | | 3/1967 | Spandock | |
| 3,405,377 | A | * | 10/1968 | Pierce | 335/285 |
| 4,150,746 | A | * | 4/1979 | Buglione | 206/372 |
| 4,179,033 | A | | 12/1979 | Mitchell | |
| 4,262,325 | A | * | 4/1981 | Garcia | 362/121 |
| 5,285,907 | A | | 2/1994 | Franchere et al. | |
| 5,660,276 | A | * | 8/1997 | Winnard | 206/350 |
| 5,743,394 | A | * | 4/1998 | Martin | 206/378 |
| 5,855,285 | A | * | 1/1999 | Laird et al. | 211/70.6 |
| 5,878,862 | A | | 3/1999 | Dewsnap | |
| 5,938,048 | A | | 8/1999 | Carroll et al. | |
| 5,947,305 | A | | 9/1999 | Lin | |
| 5,996,818 | A | | 12/1999 | Boje et al. | |
| 6,394,288 | B1 | | 5/2002 | Hartwall | |
| 6,488,151 | B2 | * | 12/2002 | Ramsey et al. | 206/378 |
| 6,520,366 | B1 | | 2/2003 | Bradley et al. | |
| 6,530,485 | B1 | | 3/2003 | Weber | |
| 6,640,981 | B2 | | 11/2003 | Lafond et al. | |
| 6,964,443 | B1 | | 11/2005 | Newton | |
| 7,108,132 | B2 | * | 9/2006 | Shih | 206/378 |

(Continued)

*Primary Examiner* — Fenn Mathew

*Assistant Examiner* — Cynthia Collado

(74) *Attorney, Agent, or Firm* — JP Webb; Jason P. Webb; Danny Y. H. Cheng

(57) ABSTRACT

There is a display device configured to couple to a structure, such as a wall. The display device includes a display module having a base plate. The display module includes an array of containers extending from the base plate. The display module includes a plurality of supports disposed between each of the containers of the array of containers. The display module includes a pair of end tabs coupled to each end of the array of containers. The display device includes a pair of brackets configured to couple to the pair of end tabs of the display module. The pair of brackets include a support plate and a channel disposed on the support plate about a 45 degree angle. The pair of brackets include an attachment surface disposed on the support plate and a vertical slit aperture disposed adjacent the channel.

10 Claims, 4 Drawing Sheets

(56) References Cited

U.S. PATENT DOCUMENTS

| | | | | |
|---|---|---|---|---|
| D551,036 | S | 9/2007 | Tomaszewski et al. | |
| 7,383,670 | B1 * | 6/2008 | Meyers | 52/843 |
| D618,074 | S | 6/2010 | Paetsch | |
| 8,096,516 | B2 * | 1/2012 | Shiao | 248/298.1 |
| 8,272,506 | B1 * | 9/2012 | Flannery et al. | 206/217 |
| 2008/0128319 | A1 | 6/2008 | Noble Colin et al. | |
| 2013/0037498 | A1 * | 2/2013 | Kao | 211/59.2 |

* cited by examiner

DISPLAY DEVICE

CROSS-REFERENCE TO RELATED APPLICATIONS

This invention claims priority, under 35 U.S.C. §120, to the U.S. Provisional Patent Application No. 61/485,875 to Victor David Williams filed on May 13, 2011, which is incorporated by reference herein.

BACKGROUND OF THE INVENTION

1. Field of the Invention

The present invention relates to a display devices, specifically to a modular display device.

2. Description of the Related Art

A display device is structure used to display objects for viewing, for example in a retail store, retail environment, or at home. In retail, the objects are normally being offered for sale. A display device may be freestanding on the floor or may be smaller and mounted on the wall. Display devices are typically made by specialist companies and often made to order. They also are made in variety of styles and materials as available at a store fixture supplier. Some improvements have been made in the field. Examples of references related to the present invention are described below, and the supported teachings of each reference are incorporated by reference herein: U.S. Pat. No. 6,964,443, U.S. Pat. No. 6,640,981, U.S. Pat. No. 6,530,485, U.S. Pat. No. 6,520,366, U.S. Pat. No. 6,394,288, U.S. Pat. No. 5,996,818, U.S. Pat. No. 5,947,305, U.S. Pat. No. 5,938,048, U.S. Pat. No. 56,878,862, U.S. Pat. No. 5,285,907, U.S. Pat. No. 4,179,033, U.S. Pat. No. 3,311,402, U.S. Pat. No. D551,036, U.S. Pat. No. D618,074, and U.S. Patent Publication No.: 2008/0128319.

The inventions heretofore known suffer from a number of disadvantages which include being limited in use, being limited in positioning, being limited in mountability, being expensive, being difficult to install, being limited in adaptability, failing to adequately support materials disposed therein, not supporting accessory devices, being awkward, having limited mounting configurations, being difficult to move, difficult to clean, difficult to replace, and the like.

What is needed is a display device that solves one or more of the problems described herein and/or one or more problems that may come to the attention of one skilled in the art upon becoming familiar with this specification.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
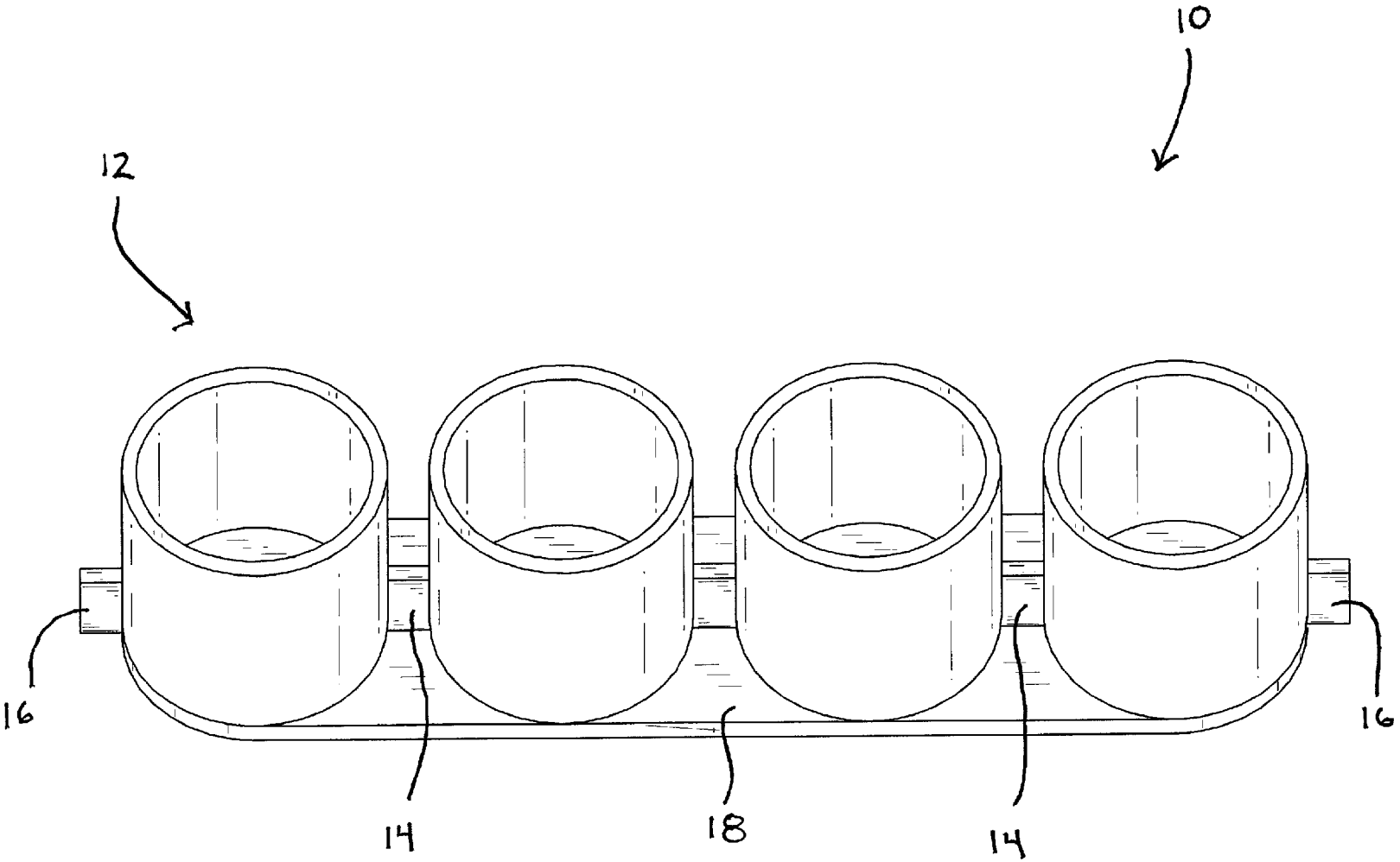
FIG. 1 is a perspective view of a display module of a display device, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

FIG. 1 is a perspective view of a display module of a display device, according to one embodiment of the invention. There is shown a display module 10 having an array of containers 12, a base plate 18, a plurality of supports 14, and a pair of end tabs 16.

The illustrated display module 10 is configured to contain articles disposed therein in a manner that facilitates physical and visual access to the contents thereof. The display module 10 includes an array of containers 12 coupled together and supported in a manner that facilitates the use thereof. The containers 12 are spaced apart and oriented in a substantially identical direction such that access to a side of the display module 10 provides access to the containers thereof. A plurality of supports 14 are provided to strengthen the display module 10 and to maintain appropriate structural integrity. Further, supports 14 may provide interface(s) for accessory devices and structures. More, the display module 10 is configured to be utilized in a modular fashion, that is, it may be easily replaced by another display module 20 and/or may take the place of another display module 10 in use.

A display module 10 may contain, hold, support, or otherwise be used an association with a plethora of articles, including but not limited to spray paint cans, brushes, tools, craft supplies, kitchen spices, food containers, hand and body products, powders, flowers, fluids, toys, electronic parts, magazines, jewelry, marketing materials, pamphlets, retail products, and the like. Advantageously, a display module 10 may hold and/or organize contents in a condensed area. Wherein the display module 10 is coupled to a surface, such as but not limited to a wall, the area may be an area that was not in use previously, thereby further enhancing the benefit of the display device.

The illustrated display module 10 includes a plurality of support members 14. The illustrated support members 14 are positioned in between each of the interior containers. The array of containers 12 and the plurality of support members 14 are coupled together along a base plate 18, disposed along a bottom end of each support member 14 and each container 12. The supports 14 are coupled to the base plate 18 and extending perpendicularly therefrom. The supports 14 are configured to extend about half way up a side wall of the interior containers. Each container 12 is configured to extend perpendicularly from the base plate 18. The illustrated display module 10 includes a pair of end tabs 16, each configured to couple to a bracket of a display device. Each end tab 16 is coupled to a exterior side wall of a exterior container of the display module 10. Each end tab 16 is positioned parallel to the supports.

In one embodiment, there is an array of containers 12 coupled in succession by a base plate 18 and having associated elongated supports 14 between adjacent containers, wherein the elongated supports 14 are planar and oriented substantially orthogonal to the base plate such that accessories coupled thereto may extend outwardly from the base plate 18. Containers 12 may have top rims that may be spaced apart from top rims of other containers and such spacing may be greater than about 0.5×, 1×, 1.5×, 2×, 2.5×, 3×, and/or 4× a width of a container wall. Containers may have a cross section that is cylindrical, square, rectangular, polygonal, irregular, or the like or combinations thereof. A base plate 18 may be planar, irregularly shaped, curved, or the like or combinations thereof. An elongated support 14 may be a planar flange extending between adjacent containers and coupled thereto. There may be an end tab 16 or fitting that may be shaped to couple to a bracket receiver such that the display module may be selectably coupled to and/or between brackets in a manner that permits placement and/or use of the display module to contain articles. A display module 10 having a flat bottomed base plate 18 may be utilized without brackets on a substantially horizontal surface.

Figure 2:
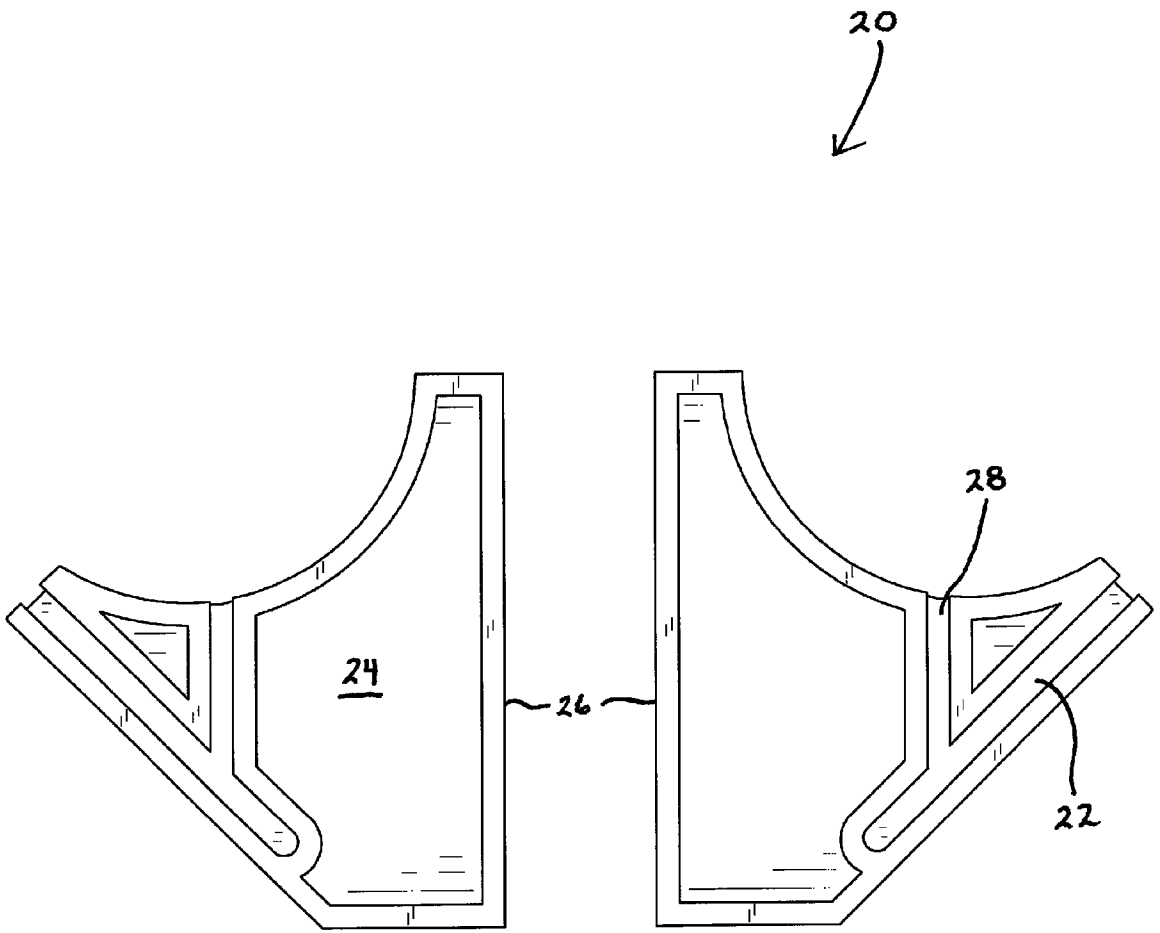
FIG. 2 is an interior plan view of a pair of brackets of a display device, according to one embodiment of the invention.

FIG. 2 is an interior plan view of a pair of brackets of a display device, according to one embodiment of the invention. There is shown a pair of brackets 20 of a display device.

Brackets 20 may be utilized to couple a display module to a surface, such as but not limited to the side of a tool table, a wall, a door, a cabinet, and the like. Brackets 20 will generally be used in pairs so that display modules may be supported at two generally opposite points, thereby stabilizing the display module. Brackets 20 may be shaped and configured to receive display modules, and in particular end tabs or fittings of display modules. Brackets 20 may include receiving structures shaped to permit fittings to be selectably coupled to brackets in a manner that provides stable positioning, such as but not limited to providing a recess 22 wherein a fitting may be placed that is shaped to resist movement of the fitting by gravity, but to provide lesser resistance to forces applied in a direction different from an anticipated gravity direction. Accordingly, display modules may be slipped into place within a pair of brackets 20 and left until needed elsewhere, whence they may be lifted out of the brackets 20. There may be spacers extending from a bracket 20 that may be shaped and/or sized to facilitate spacing successive brackets 20 on a surface so that particular spacing between rows is maintained. Such spacers may include measuring indicators, such as but not limited to ticks, marks, numbers, lines and the like.

The illustrated brackets 20 are mirror images of each other and each include a support plate 24 having ridges extending therefrom forming an attachment surface and channel architecture, including a channel 32 configured to receive an end tab of the display module. Each bracket 20 also includes an attachment surface configured to provide a flat surface to couple the bracket 20 to a structure or wall. The illustrated channel 22 is angled at a 45 degree angle, relative to the attachment surface 26. The bracket 20 is configured to support the display module in a substantially diagonally, 45 degree angle, configuration. The attachment surface 26 is configured to attach to a structure without the need for hardware, such as nails or screws that may permanently damage the structure or wall. The attachment surface 26 is coupled to the structure using an adhesive. The bracket 20 also includes a vertical slit aperture 28 disposed adjacent the channel 22 and positioned parallel to the attachment surface 26. The slit aperture 28 is configured to receive an end tab of the display module and position a display module in a substantially upright vertical position. Wherein the illustrated display module of FIG. 1 is coupled to the vertical slit, the containers are oriented vertically (substantially parallel to a surface coupled to the brackets). Wherein the illustrated display module of FIG. 1 is coupled to the angled channel, the containers are oriented diagonally (extending outwardly at an angle from the surface coupled to the brackets).

In one embodiment, there may be a bracket 20 having a first side that may be substantially orthogonal to a second side. The first side may be shaped to couple to a surface, such as but not limited to including screw/nail holes, ridges, spikes, and the liked and combinations thereof for coupling the bracket to a surface. The second side may be shaped and sized to provide spacing and support for a receiver extending therefrom. The receiver may include structure, such as but not limited to one or more channels, holes, apertures, grooves, tongues, other mating devices and the like and combinations thereof. The receiver may include a plurality of channels or the like that may be oriented in different directions, such that when coupled to a fitting or end tab, may cause a display module to be oriented in different directions or spaced in different manners. Channels and other mating devices and the like may be oriented such that display modules are displayed at angles including but not limited to 0, 10, 15, 20, 30, 35, 40, 45, 50, 55, 60, 65, 70, 75, 80, 85, and 90 degrees. Channels and/or other mating devices may share structure across different angle modes, such as the shared channel architecture between the angled channel and the vertical slit aperture of FIG. 2.

Figure 3:
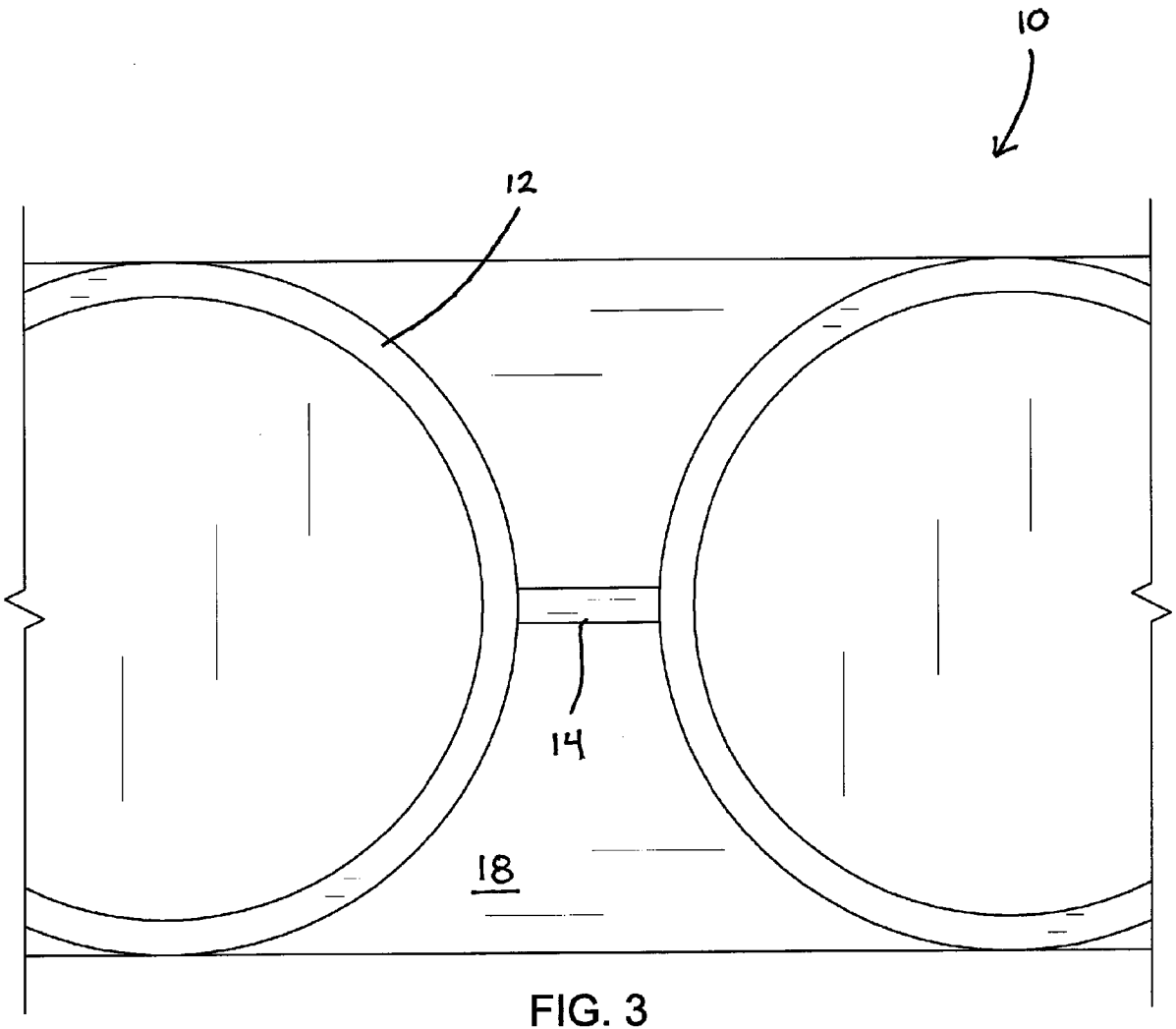
FIG. 3 is a partial top plan view of support members of a display module coupled by an elongated support, according to one embodiment of the invention.

FIG. 3 is a partial top plan view of containers of a display module coupled by support, according to one embodiment of the invention. There is shown a support 14 coupling a pair of containers 12 of a display module 10.

The illustrated support 14 is disposed between a pair of containers 12 of a display module 10. The support 14 is configured to separate the containers 12 an equal distance apart. The space between the containers 12, created by the support 14, is configured to hold or support an item. Each support 14 is configured to extend from a base plate 18 of the display module 10. Each support member 14 is configured to extend about half way up a side wall of the interior containers 12 of the display module 10.

The illustrated support 14 may form a support for an accessory device that may couple to the support 14 by pinching the support 14 between a pair of brackets. The accessory may include but is not limited to covers, signs, lights, arches, dangling containers, hangars, tags, handles, levers, electronic devices, and the like and combinations thereof.

Figure 4:
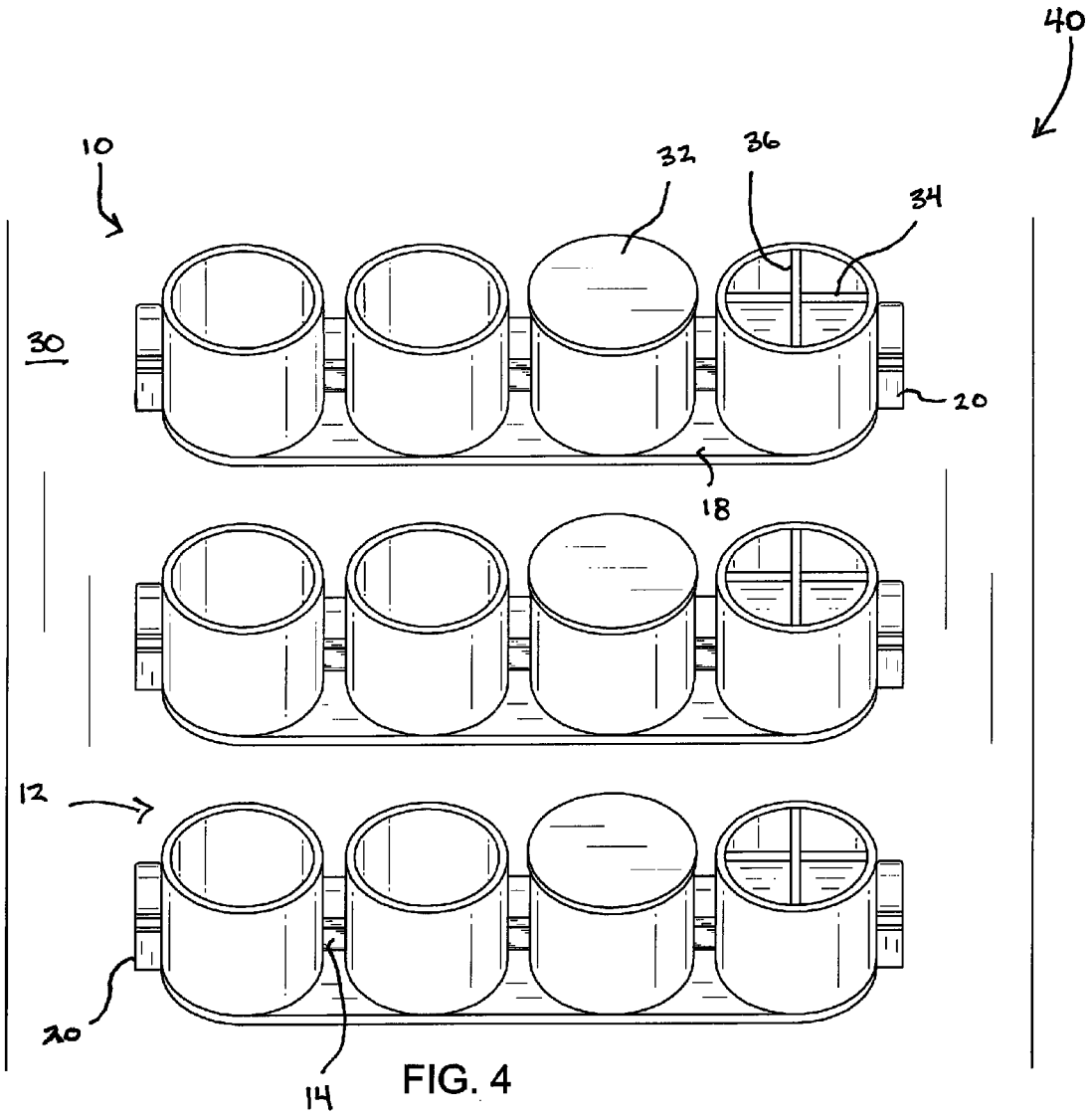
FIG. 4 is a perspective view of a plurality of display devices coupled to a structure, according to one embodiment of the invention.

FIG. 4 is a perspective view of a plurality of display devices coupled to a structure in an array, according to one embodiment of the invention. There is shown a plurality of display devices 40 coupled to a wall 30 by a plurality of brackets 20.

The illustrated display devices 40, each include a display module 10 coupled to a pair of brackets 20. The brackets 20 are coupled to a structure 30, such as the illustrated wall. The pair of brackets 20 are coupled to the structure 30 using an adhesive along an attachment surface of the bracket 20. The brackets 20 are configured to position the plurality of display modules 10 at a 45 degree angle from the structure 30. The illustrated display module 10 includes an array of containers 12. The illustrated display device 40 includes a cap 32 configured to cover an open end of the container 12. The illustrated display device 40 also includes a divider 34, 36 disposed within the container 12 and is configured to divide the interior of the container 12 into sections. The divider includes a pair of plates 34, 36 having a slit positioned through a side of the divider into a center region. The pair of plates 34, 36 are configured to couple together by sliding the slit of a plate through the slit of the other plate, thereby forming a cross within the interior of the container.

In one embodiment, display modules 10 may be coupled to brackets 20 at varying angles in an array. As a non-limiting example, a top display module may be coupled vertically while display modules disposed lower than the top display module may be oriented at a 45 degree angle. Accordingly, articles extending from the display modules may be restricted from interfering with each other and articles that should not be angled can be held in the top display module. Also, materials that may travel from workstation to workstation may be more easily removed if oriented vertically at the top of an array. More, a display module may be mounted upside down, thereby providing a flat shelf that may be oriented horizontally, diagonally, or otherwise depending on the orientation of the mating device.

In operation of one embodiment of the invention, a user disposes an adhesive about an attachment surface of a first end cap of a display device and couples the first end cap to a structure or wall. The user aligns a second end cap to match the first end cap and disposed adhesive about an attachment surface of the second end cap and couples the end cap to the structure or wall. The user then slides a display module into either the 45 degree channel of the vertical slit aperture. The user may position the display module at either angle, 45 degree angle or vertical, depending on the structure or wall. The user may dispose a divider to the support member and separate the interior of the support member into sections or dispose a cap over the open end of the support member to seal the open end of the display bracket.

Advantageously, a display module may be removed from its associated brackets and taken to another location. Further, such may be turned over to remove its contents without difficulty. Still more, wherein the display modules are appropriately sized and made of an appropriate material, they may be washed in a standard dishwasher without need for special cleaning materials, mounts, supports, or the like.

Spacing between the containers of a display module facilitates placement of accessory devices therein, therebetween and the like, such as but not limited to caps, dividers, tags, labels, funnel members, connectors, bridging members, support members and the like that may extend outside the containers.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the Figures illustrate a cylindrical support member, one skilled in the art would appreciate that the support member may vary in size, shape, design, configuration, color, length, height, width, circumference, diameter, and still perform its intended function.

Additionally, although the figures illustrate a channel disposed substantially about a 45 degree angle, one skilled in the art would appreciate that the channel may vary in angle, size, shape, design, configuration, position, color, length, height, width, circumference, diameter, and still perform its intended function.

It is envisioned that, one skilled in the art would appreciate that, the brackets may include a plurality of brackets coupled together in vertical succession, thereby providing a display device with a plurality of support members disposed vertically in succession and still perform its intended function.

Finally, it is envisioned that the components of the device may be constructed of a variety of materials, such as but not limited to: plastic, dishwasher-safe plastic, plastic composite, rubber, rubber composite, wood, fiber, glass, metal, metal alloys, etc, and the like and combinations thereof and still perform its intended function.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A display device configured to couple to a structure, comprising:

a) a display module, comprising:

a1) a base plate;

a2) an array of containers extending from the base plate;

a3) a plurality of supports disposed between the array of containers; and a4) a pair of end tabs coupled to each end of the array of containers; and b) a pair of brackets, each a mirror image of the other, selectably coupleable to the pair of end tabs of the display module, comprising:

b1) a support plate;

b2) a channel disposed on the support plate about a 45 degree angle to the support plate;

b3) an attachment surface disposed on the support plate; and b4) a vertical slit aperture substantially parallel to the support plate and disposed adjacent the channel, intersecting therewith at about a 45 degree angle thereto.

2. The device of claim 1, wherein the array of containers include a circular configuration.

3. The device of claim 1, wherein the vertical slit aperture receives the pair of end tabs from the pair of brackets.

4. The device of claim 1, wherein channel and the vertical slit aperture intersect.

5. The device of claim 1, wherein the pair of ends tabs are disposed parallel to the plurality of supports.

6. The device of claim 1, wherein the channel is slightly wider in width than a width of the pair of end tabs.

7. The device of claim 1, further comprising a cap configured to cover an open end of the container.

8. The device of claim 1, further comprising a divider disposed within the container and is configured to divide the interior of the container into sections; wherein the divider includes a pair of plates having a slit positioned through a side of the divider into a center region.

9. The device of claim 1, wherein the plurality of supports extend about half way up a side wall of the interior containers.

10. The device of claim 1, wherein the array of containers extend perpendicularly from the base plate.

* * * * *